United States Patent [19]

Jarvis et al.

[11] 4,134,414

[45] Jan. 16, 1979

[54] ADJUSTABLE UPPER SPRAY ARM FOR DISHWASHER

[75] Inventors: Wilbur W. Jarvis, St. Joseph; Leslie Toth, Coloma, both of Mich.

[73] Assignee: Whirlpool Corporation, Benton Harbor, Mich.

[21] Appl. No.: 805,977

[22] Filed: Jun. 13, 1977

[51] Int. Cl.[2] ..... B08B 3/02

[52] U.S. Cl. ..... 134/144; 134/176; 239/587

[58] Field of Search ..... 134/144, 145, 172, 176, 134/179, 198, 148, 165; 239/261, 587

[56] References Cited

U.S. PATENT DOCUMENTS

| | | | |
|---|---|---|---|
| 2,799,285 | 7/1957 | Lines | 134/165 X |
| 3,951,683 | 4/1976 | Jarvis et al. | 134/144 |
| 3,969,137 | 7/1976 | Jenkins et al. | 134/176 |

FOREIGN PATENT DOCUMENTS

| | | | |
|---|---|---|---|
| 1946835 | 3/1970 | Fed. Rep. of Germany | 134/144 |
| 770179 | 3/1957 | United Kingdom | 239/587 |

*Primary Examiner*—Robert L. Bleutge

*Attorney, Agent, or Firm*—Wegner, Stellman, McCord, Wiles & Wood

[57] ABSTRACT

An apparatus for selectively modifying the vertical height of an upwardly extending tower structure for an automatic dishwashing appliance. The tower structure is provided with a bearing surface adapted to receive a collar having an upper end on which a rotatable spray arm may be mounted. As selected by the operator of the dishwashing appliance, the vertical height of the collar may be modified such that the upper spray arm is positioned in an upper or a lower position.

3 Claims, 8 Drawing Figures

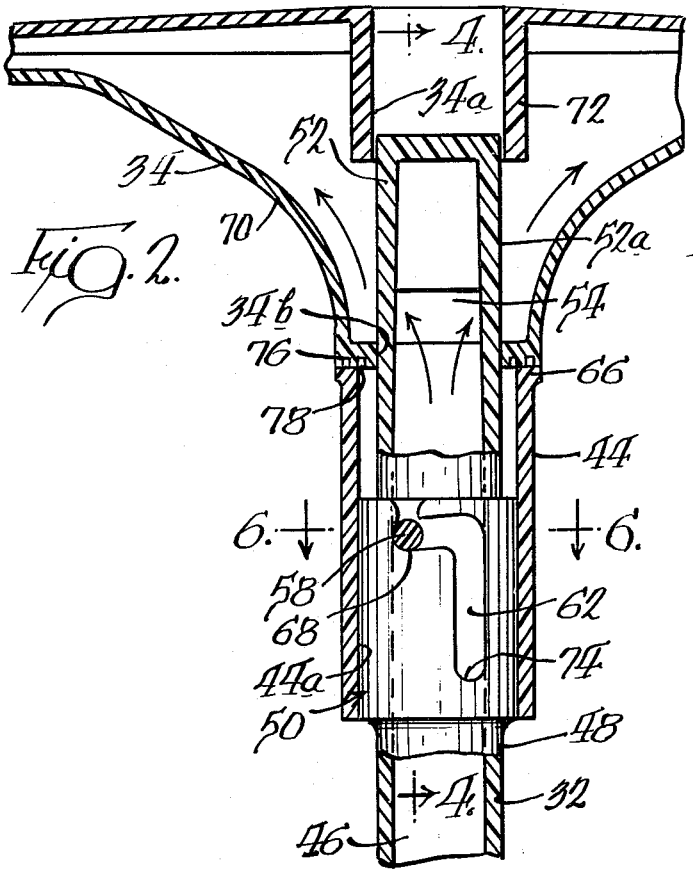
Fig. 2.
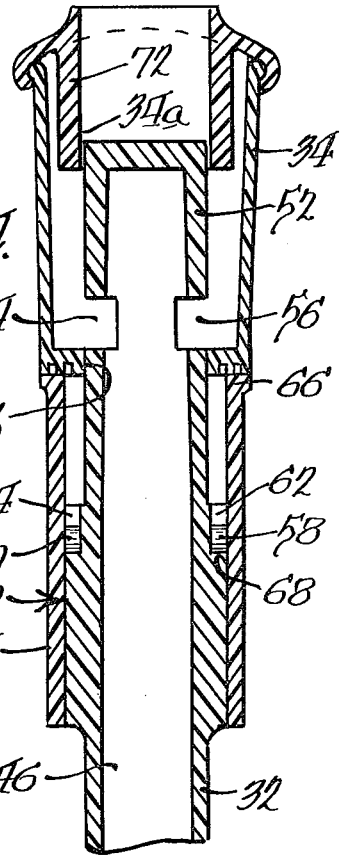
Fig. 4.
Fig. 3.
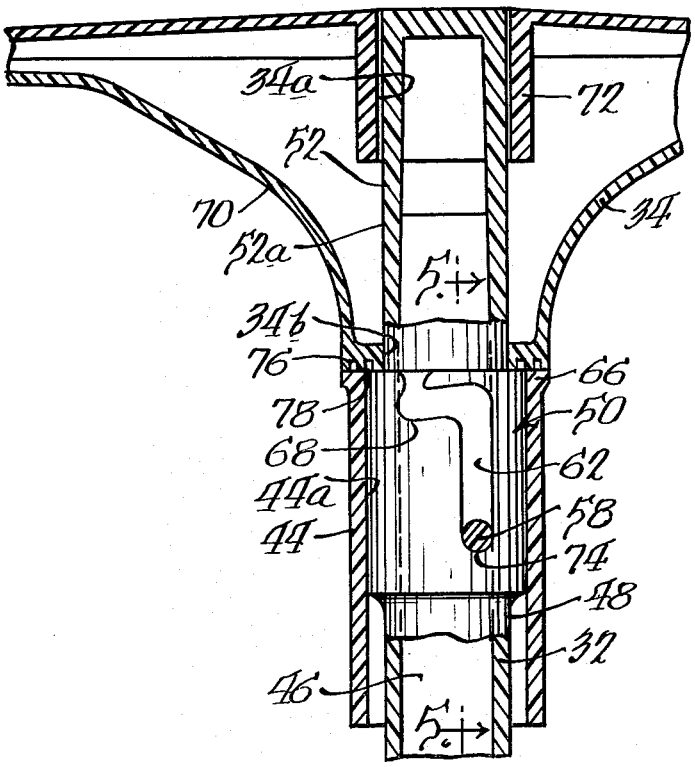
Fig. 6.
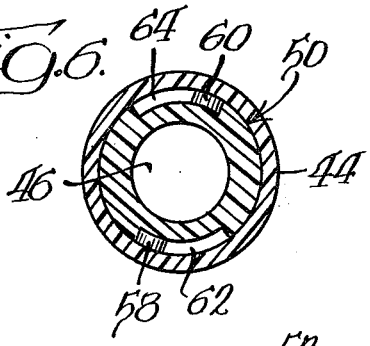
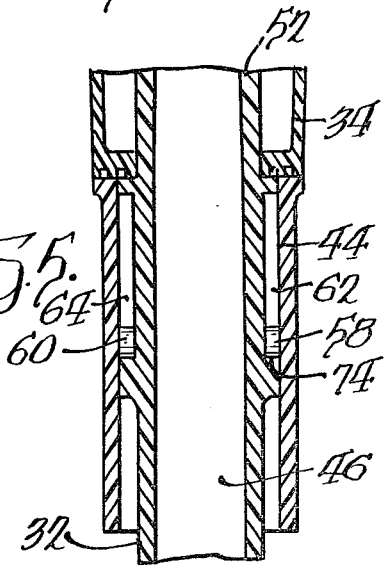
Fig. 5.

ADJUSTABLE UPPER SPRAY ARM FOR DISHWASHER

BACKGROUND OF THE INVENTION

The present invention relates to dishwashing appliances and, more particularly, to a wash liquid spray system within the appliance.

U.S. Pat. No. 3,951,683 to Jarvis et al, assigned to the assignee of the present invention, discloses a vertically extending hollow tower attached to a lower dish-supporting rack. A rotatable spray arm is mounted on the upper end of the tower so that wash liquid spray ejected therefrom causes the arm to rotate. A bellows-like coupling, coupled to a lower spray arm, is provided directly beneath the tower when the lower dish-supporting rack is in its operating position. As wash liquid is forced upwardly through the bellows-like coupling member, it expands and contacts the lower end of the tower to provide a seal. Wash liquid flows from the pump through the tower and to the upper spray arm for distribution onto the dishes within the washing chamber of the appliance. An upper dish-supporting rack is positioned above the upper spray arm so that the wash liquid is distributed onto dishes within the upper and lower dish-supporting racks. The height of the tower and the upper spray arm is fixed with respect to the lower and upper dish-supporting racks.

There are instances when it is desirable to have the upper spray arm closer to the upper dish-supporting rack than that provided by the fixed height tower of Jarvis, et al. For example, if the height of the tower were adjustable, larger pans and dishes could be contained within the lower dish-supporting rack. However, there are also instances when it is more desirable to have the spray arm at the height provided by Jarvis, et al. It is particularily desirable for the vertical position of the spray arm to be adjustable where the vertical height of the upper dish rack may be selectively adjusted with respect to the lower dish rack. In this case the adjustability of the spray arms position allows a proper relationship to be maintained between the spray arm and the upper dish rack.

Considering the drawback of the tower having a fixed height with respect to the upper and lower dish-supporting racks, we have developed a tower which selectively retains the upper rotatable spray arm at a lower or an upper level. The height of the upper spray arm is easily ajustable by the operator and improves the overall operation of the appliance.

During the preparation of this application, the following additional patents were considered:

U.S. Pat. No. 1,577,225 to Granger;
U.S. Pat. No. 2,726,666 to Oxford;
U.S. Pat. No. 3,077,200 to Guth;
U.S. Pat. No. 3,404,841 to Brittain et al;
U.S. Pat. No. 3,598,130 to Nolte et al;
U.S. Pat. No. 3,813,043 to Mordehai;
U.S. Pat. No. 3,951,684 to LaPrad et al;

SUMMARY OF THE INVENTION

A vertically adjustable tower structure for an automatic dishwashing appliance is provided to accomodate the placement of larger dishes in the lower dish-supporting rack or the adjustment of the upper rack and to improve washing characteristics of the appliance. The upper end of the tower is provided with a bearing surface having outwardly opening inverted L-shaped grooves which receive radially inwardly extending protrusions on the inner surface of an annularly disposed collar. The cooperation of the collar and the grooves permits the collar to be retained at an upper and a lower position. The upper end of the collar extends outwardly into a flange which supports a lower surface of the rotatable upper spray arm. The operator may adjust the position of the spray arm by manually engaging the collar, rotating same, and urging it upwardly or downwardly as the case may be.

It is a feature of the present invention to provide a collar on a tower to selectively modify the height of the upper spray arm with respect to the lower dish-supporting rack.

Another feature of the present invention is to provide an inexpensive yet reliable adjustable tower and spray arm.

Yet another feature of the present invention is to provide an adjustable collar so that larger dishes and pans may be inserted in the lower dish-supporting rack without obstructing the rotation of the upper spray arm.

Still another feature of the present invention is to provide an adjustable collar so that the upper spray arm may be adjusted to efficiently operate in relation to the upper dish-supporting rack when the position of the upper rack is adjusted.

Other features will become apparent when considering the drawing in which:

DRAWING

FIG. 2 is a cross-sectional view of the spray arm and the upper portion of the tower when the spray arm is in its uppermost position;

FIG. 3 is a cross-sectional view of the rotatable spray arm and the upper section of the tower when the spray arm is in its lower position;

FIG. 4 is a cross-sectional view taken through line 4—4 of FIG. 2;

FIG. 5 is a cross-sectional view taken through line 5—5 of FIG. 3;

FIG. 6 is a cross-sectional view of the tower and the collar taken through line 6—6 of FIG. 3;

DESCRIPTION OF PREFERRED EMBODIMENT

Figure 1:
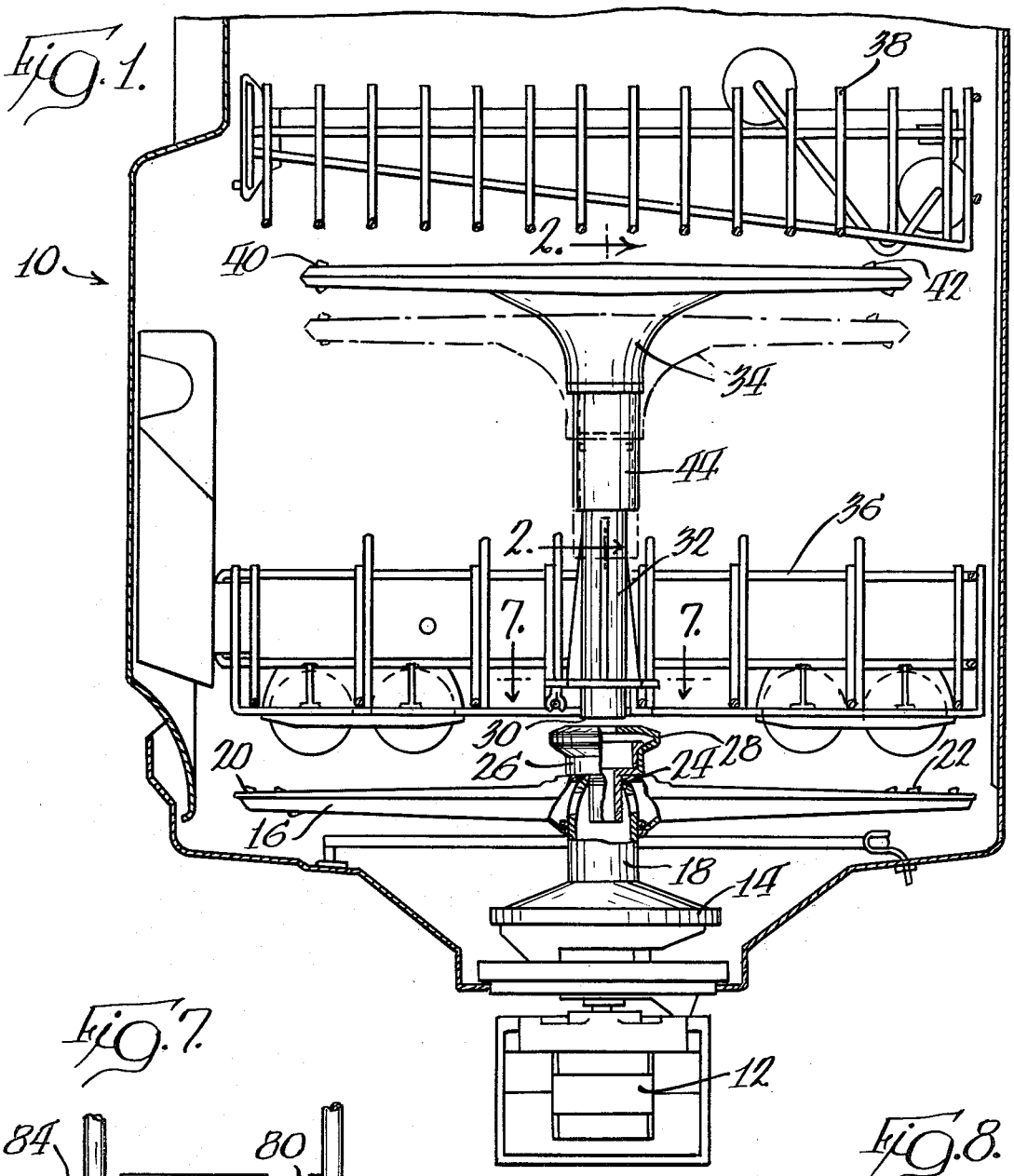
FIG. 1 is an elevational view of the dishwashing appliance having the adjustable tower in accordance with the present invention.

Referring to FIG. 1, front-loading dishwasher 10 is of generally known construction having a motor 12, a pump means in the form of a water pump 14 and a lower spray arm 16 which is mounted for rotation on upwardly extending hollow core 18. The lower spray arm 16 is provided with opposing apertures 20 and 22 so that a portion of the pressurized wash liquid provided to the lower spray arm from pump 14 exits from apertures 20 and 22 causing it to rotate in the well known manner. Core 18 has an annular threaded bore 24 which receives a fixed hub 26. Fixed hub 26 has a resilient bellows 28 on its upper end and is adapted to engage an inlet 30 of a tower structure 32 when pressurized wash liquid urges bellows 28 upwardly and outwardly. This means for providing a fluid coupling between the pump means and the tower is explained in detail in U.S. Pat. No. 3,951,683 to Jarvis et al.

Pressurized wash liquid from pump 14 flows through core 18 and fixed hub 26 and enters the tower structure 32 at inlet 30, the tower acting as a fluid conduit for the washing liquid. Liquid is urged upwardly by the force of pressure developed by pump 14 to an upper spray arm 34. Upper spray arm 34 is located between a lower dish-supporting rack 36 and an upper dish-supporting rack 38. Upper spray arm 34, having opposing apertures 40 and 42, rotates on the tower structure 32 when wash liquid exits therefrom in the well known manner. The primary function of the upper spray arm 34 is to distribute washing liquid under pressure in the direction of the upper rack 38 to provide a washing action against the contents of said rack. The height of upper spray arm 34 on the tower structure 32 is controlled by the manual vertical positioning of a collar 44 which adjusts the vertical position of the spray arm 34.

Collar 44 is concentrically mounted on the outer surface of tower structure 32 and moves axially with respect to tower structure 32 between a lower position (shown by the phantom line in FIG. 1) and an upper position. The operator decides whether the upper spray arm 34 would likely perform more satisfactorily in the upper or the lower position, and if it is desired to change the vertical position of the collar, and hence the position of the upper spray arm, the operator manually engages collar 44 and, with a twisting motion, manipulates the collar by urging the collar 44 either upwardly or downwardly, depending upon the desired position, to an upper or a lower position where it is retained.

Referring to FIGS. 2–6, tower structure 32 has an axially extending cavity 46 in communication with inlet 30 for wash liquid flow. The upper end 48 of tower 32 is integrally coupled to outwardly extending surface 50 which receives collar 44. The interaction or cooperation of a surface **44*a* of collar 44 and the corresponding surface 50 facilitate the adjustment of the height of the spray arm 34 between an upper and a lower position. A hollow closed end extrusion 52 extends upwardly from the bearing surface 50. Closed end extrusion 52 is provided with opposing slots 54 and 56 to accomodate wash liquid flow from cavity 46 and is of a height sufficient to retain upper spray arm 34 in its uppermost position, as shown in FIG. 2. The arrows shown in FIG. 2 depict the direction of wash liquid flow. The extrusion 52 also defines a bearing surface 52*a* against which upper aid lower bearing surfaces 34*a* and 34*b* respectively of the upper spray arm 34 act to provide a generally free rotation of the spray arm 34 on tower 32**.

Collar 44, concentrically disposed about surface 50, has opposing and radially inwardly extending protrusions 58 and 60. Protrusions 58 and 60 are received within opposing outwardly opening grooves 62 and 64, respectively. The diameter of protrusions 58 and 60 and the width of the grooves 62 and 64 are selected such that the collar 44 moves freely with respect to surface 50 when manually adjusted by the operator. Grooves 62 and 64 may take on any particular configuration which may provide for an upper and a lower position of collar 44. As an example of an easily-machined or molded, simple and reliable configuration, an inverted L-shaped groove may be employed. Each inverted L-shaped groove, as shown in the figures, is provided with an upper detent surface 68 on which rest the protrusions 58 and 60, when retaining collar 44 in its uppermost retained position. The height of each detent surface 68 is selected in accordance with the axial length of the manifold 70 of upper spray arm 34 as well as the length of extrusion 52. Specifically, the downwardly extending nipple 72 of manifold 70 must be of sufficient length to overlap the upper end of extrusion 52 to prevent translational movement of the spray arm 34 during rotation. Grooves 62 and 64 are also each provided with a lower detent surface 74 on which radially extending protrusions 58 and 60 ride retaining collar 44 in its lower retained position. The position of the lower detent surfaces 74 may be selected such that an outwardly extending annular flange portion 66 on collar 44 is coplanar with the upper surface of the surface 50. If the upper detent 68 and the lower detent 74 are positioned in the manner discussed above, the junction between the rotatable spray arm 34 and the collar 44 may be appropriately sealed to substantially preclude waterflow therethrough. Specifically, O-rings may be provided in annular slots 76 and 78 to effect a suitable seal.

Figure 7:
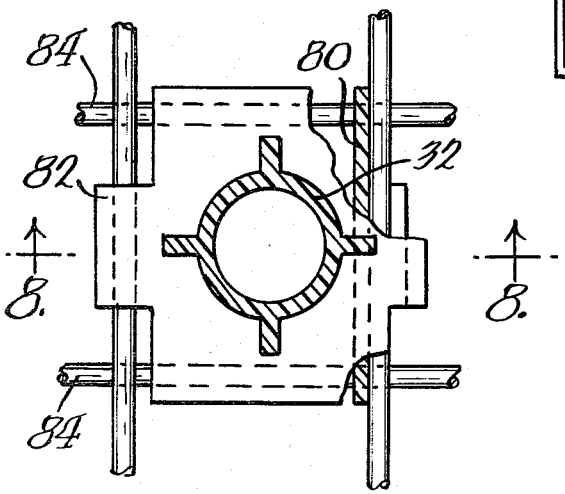
FIG. 7 is a top view of the tower mounted on the lower dish-supporting rack as shown in FIG. 1.
Figure 8:
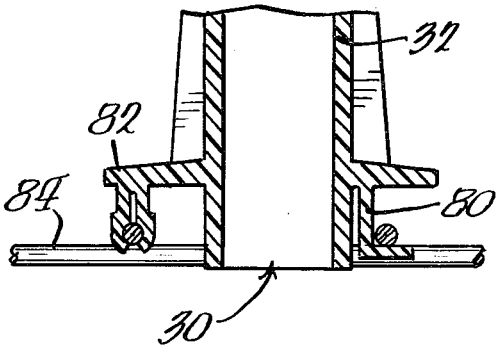
FIG. 8 is a side view of the lower portion of the tower taken through line 8—8 of FIG. 7.

The arrangement of the collar 44 in combination with surface 50 to provide a vertically movable upper support for spray arm 34 applies equally to a tower which is rigidly attached to the dishwasher 10 or to lower rack 36. Specifically, and as explained in greater detail in the Jarvis et al patent referred to earlier herein, the base of tower structure 32 may be provided with hook-like attachment structures 80 and clip-like attachment structure 82 which are received by wire strands 84 of lower rack 36. This is best seen in FIGS. 7 and 8.

It should also be understood that although only a two-position adjustment of the upper spray arm on the tower has been specifically described herein, more than two positions could be provided. For example, the grooves 62 could assume any one of a great variety of different configurations and could for instance have more than one detent surface 68 with different detent surfaces located at different vertical levels on the tower.

Although the tower structure bearing surface 50 and collar 44 may be made of any suitable material, we prefer to use polypropylene.

Having described the invention, the embodiments of the invention in which an exclusive property or privilege is claimed are defined as follows:

1. In a dishwashing appliance having a tub, an upper dish-supporting rack movably mounted in said tub, a lower dish-supporting rack mounted in said tub below said upper rack for movement between a loading and an operating position, pump means below said lower rack for providing washing liquid under pressure, a tower having an axis and including first and second ends and defining a fluid conduit therebetween with said first end of said conduit fixed to said rack, means for providing a fluid coupling between said first end of said tower and said pump means with said lower rack in said operating position, and an upper spray arm rotatably carried by said second end of said tower for distributing washing liquid toward said upper rack, the improvement comprising:

a collar engageable with said second end of said tower at at least two selected vertical positions on said tower for supporting said upper spray arm on said tower at said selected vertical positions;

a first surface on said tower and a second surface on said collar, said surfaces being parallel to said axis and cooperating to provide said upper spray arm at said selected vertical positions; and means for retaining the spray arm at said selected positions including a projection extending from one of said surfaces in a generally radial direction with respect to said axis, and a groove defined on the other of said surfaces for receiving said projection, said groove including surface portions for retaining said projection in more than one location with said groove, whereby said vertical position of said upper spray arm is adjusted by manipulating said collar on said tower to move said projection within said groove from one location to another.

2. In a dishwashing appliance of claim 1 wherein the groove is of inverted L-shape and the collar may be manipulated between a raised and a lowered position to effect a corresponding adjustment of said upper spray arm.

3. In a dishwashing appliance of claim 1 wherein said tower includes a portion defining a bearing surface above said first surface on said tower, and said upper spray arm includes vertically spaced portions defining upper and lower bearing surfaces for cooperation with said bearing surface on said tower, said upper bearing surface of said upper spray arm having a portion thereof cooperating with said bearing surface on said tower for both raised and lowered positions of said upper spray arm.

* * * * *